US012092128B2

(12) United States Patent
Bowman et al.

(10) Patent No.: US 12,092,128 B2
(45) **Date of Patent: *Sep. 17, 2024**

(54) BOUNDARY-LAYER PUMP AND METHOD OF USE

(71) Applicants: John Lloyd Bowman, New Orleans, LA (US); Ricky Jay Jackson, Williamston, MI (US); Bryan Patrick Killeen, New Orleans, LA (US)

(72) Inventors: John Lloyd Bowman, New Orleans, LA (US); Ricky Jay Jackson, Williamston, MI (US); Bryan Patrick Killeen, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/197,011

(22) Filed: May 12, 2023

(65) Prior Publication Data

US 2023/0279858 A1 Sep. 7, 2023

Related U.S. Application Data

(63) Continuation-in-part of application No. 17/627,841, filed as application No. PCT/US2021/049884 on Sep. 10, 2021, now Pat. No. 11,859,632.
(Continued)

(51) Int. Cl.
*F04D 5/00* (2006.01)
*F04D 29/18* (2006.01)
(Continued)

(52) U.S. Cl.
CPC ..... *F04D 29/287* (2013.01); *F04D 5/001* (2013.01); *F04D 29/185* (2013.01); *F04D 9/004* (2013.01)

(58) Field of Classification Search
CPC ..... F04D 5/001; F04D 9/004; F04D 29/185; F04D 29/287
See application file for complete search history.

(56) References Cited

U.S. PATENT DOCUMENTS 3,697,190 A 10/1972 Haentjens
5,312,224 A 5/1994 Batchelder et al.
(Continued)

FOREIGN PATENT DOCUMENTS

CH 677254 4/1991
CN 208060348 U 11/2018

OTHER PUBLICATIONS

PCT/US2021/049884 International Search report dated Dec. 20, 2021.

*Primary Examiner* — Topaz L. Elliott
*Assistant Examiner* — Jason G Davis
(74) *Attorney, Agent, or Firm* — Veritay GroupIP, PLLC; Susan B. Fentres

(57) ABSTRACT

A device for pumping fluid such as paints, sealants, caulks, and polymers made of a rotor assembly and a pump body. The rotor assembly contains at least one laminar flow element arranged in such a manner as to conduct the fluid from inlet to outlet as the rotor spins. The rotor may vary its distance from the pump body. This arrangement provides a rotor with exceptional capacity to pump without damage to the fluid media and to measure the fluid rate at low or high rotational speed with viscosity that can vary. The device also may provide a spray nozzle or nozzles that produce a multiplicity of spray patterns.

19 Claims, 16 Drawing Sheets

Related U.S. Application Data

(60) Provisional application No. 63/109,494, filed on Nov. 4, 2020.

(51) Int. Cl.
*F04D 29/28* (2006.01)
*F04D 9/00* (2006.01)

(56) References Cited

U.S. PATENT DOCUMENTS

| | | | | |
|---|---|---|---|---|
| 9,295,336 | B2 | 3/2016 | Driscoll, Jr. et al. | |
| 10,947,992 | B2 | 3/2021 | Sarmiento | |
| 2010/0158672 | A1 | 6/2010 | Helmer et al. | |
| 2011/0097189 | A1* | 4/2011 | Sandoval | F01D 1/36 415/68 |
| 2011/0305589 | A1 | 12/2011 | Daunheimer | |

* cited by examiner

FIG 11a : 2Pi*IR Rotor Performance
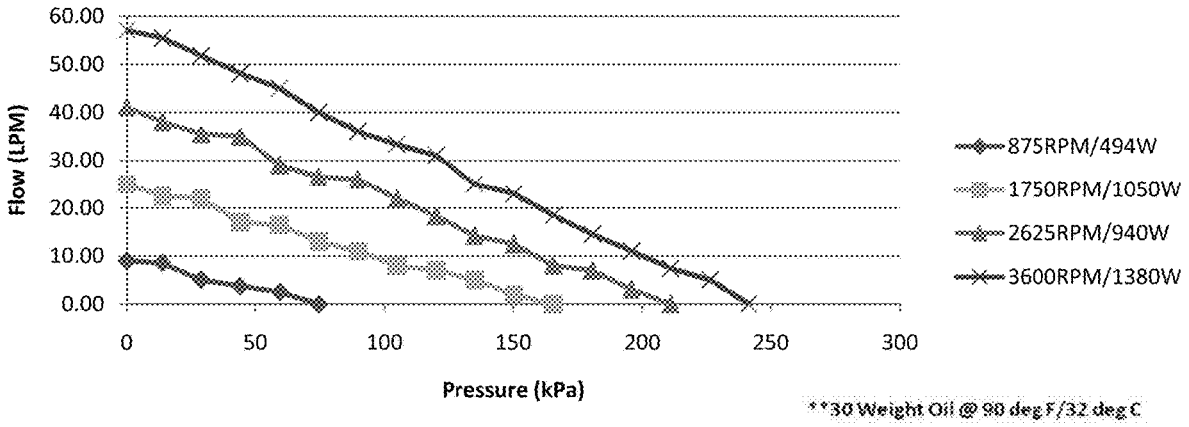
FIG 11b : Annular Rotor Performance
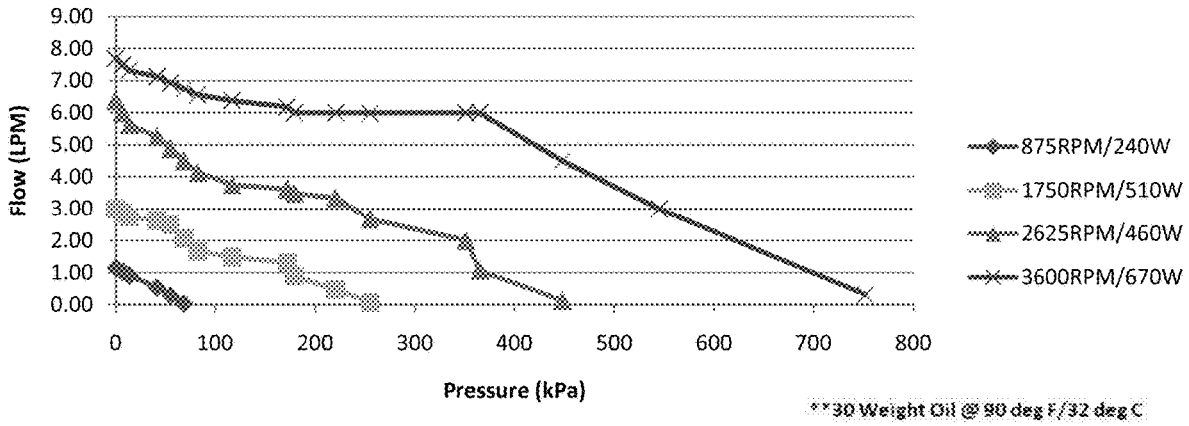

BOUNDARY-LAYER PUMP AND METHOD OF USE

CROSS-REFERENCE TO RELATED APPLICATIONS

This application is a continuation-in-part of U.S. Ser. No. 17/627,841 filed Jan. 18, 2022, PCT/US21/49884 filed Sep. 10, 2021 and U.S. provisional patent application No. 63/109,494 filed Nov. 4, 2020, under 35 U.S.C. Sec. 119(e) (hereby incorporated by reference in their entirety).

STATEMENT REGARDING FEDERALLY SPONSORED RESEARCH AND DEVELOPMENT

Not applicable

FIELD OF THE INVENTION

This invention relates to a boundary-layer pump and its use to pump varying viscosities without clogging and that will precisely meter fluid media.

BACKGROUND OF THE INVENTION

Description of the related art including information disclosed under 37 CFR 1.97 and 37 CFR 1.98. In the field of fluid pumps there are a variety of designs. Perhaps the oldest and most famous design is the Archimedes screw. This design uses a helical surface mounted on a rotary axis to move fluid through a pipe. It is the most efficient means of moving high volumes of fluid at low pressure and is still used in municipal pumping stations throughout the world.

Since Ancient Greece, other pumps have evolved. The gear pump was invented in 1593 and uses two meshing gears to move fluid in a confined cavity. Pumps invented in the 1600s include the centrifugal pump which uses rotating vanes and centrifugal force to pull fluid from an axial inlet to a peripheral outlet, and the piston pump which uses a reciprocating piston to move fluid through inlet and outlet valves. Pumps invented in the 1900s include the peristaltic pump which uses a rotating set of rollers to push fluid through a collapsible tube, and the diaphragm pump which uses a flexible membrane to create a cavity of varying internal volume similar to the piston pump. There are many variations on each of these pumps and several exotic types of pump. One example of an exotic pump is the multi-stage centrifugal, which feeds the output of one centrifugal pump to the inlet of another, thus increasing total pressure.

Every pump has advantages and disadvantages which make it most suitable for a particular application or media. Of particular interest in the present case are the fluids of high viscosity, which include machine oils, crude oils, petroleum, paints, protective coatings, additives, dyes, glues, sealants, caulks, slurries, resins, soaps, polishes, syrups, vegetable oils, fruit and vegetable pastes, dairy products, medicines, cosmetics, and many others.

Taking paint as a specific example, we can examine the needs of industry. In industrial/commercial applications, paint must be supplied to a spray head at high, uninterrupted pressure. Variations in pressure can alter the volume of paint delivered through a nozzle and thus produce inconsistencies in the thickness and quality of the deposited media. Therefore, it is of critical importance that pressure and flow should be precisely metered. Advanced paints have additives, such as metal flakes, which are expensive and functionally important, and which may be damaged by crushing points such as those in gear pumps and gear meters.

In another example, two-part resins are used in high-performance coatings and as a solidifying agent in fiberglass fabrication. Peristaltic pumps are often chosen as the dosing pump for these applications, but inevitably the rubber hoses used in these pumps degrade over time and must be replaced. This novel subject matter provides a pump that will not damage fluid additives, which will work in high- and low-pressure conditions, solving a long existing technical problem.

BRIEF SUMMARY OF THE INVENTION

We introduce herein a pump whose rotor is constructed with at least one continuous helical or spiraling feature(s) or channel(s) that when rotating inside of the stator/housing moves fluid media in less-than-turbulent and mostly laminar flow. Although this pump shares the simplicity of centrifugal pumps, it abandons centrifugal force as the primary motive force and instead uses boundary-layer effects to move the media and to develop high pressures. Unlike a centrifugal pump, this pump is reversible in flow direction. The rotor within the stator may have one or more bearings and shaft seals. An adjustment cap may allow for a controlled, variable separation of the rotor from the fixed stator. This eliminates the crush potential of media additives, like particles, or in the case of highly viscous media, constriction inhibiting a desired flow. The bearing may be a thrust bearing which allows the rotor to operate against extreme pressure without seizing against the adjustment cap.

The inventive subject matter includes: a boundary-layer pump made of: a pump body configured to receive a rotor assembly, said rotor assembly comprised of an input shaft configured to rotate the rotor assembly and a laminar fluid flow channel, wherein said pump body has a proximal end proximal to the input shaft and a distal-end distal to the input shaft, an at least one primary inlet port and an at least one primary outlet port and an adjustment cap, wherein the rotor assembly is comprised of an at least one rotor disk positioned on a shaft-type rotor wherein each of the at least one rotor disks are alternately positioned in contact between a corresponding an at least two stationary stator disks, wherein the at least two stator disks are separated by an at least one disk spacer.

In one embodiment, a boundary-layer pump is made of a pump body configured to receive a rotor assembly, said rotor assembly comprised of an input shaft configured to rotate the rotor assembly and a laminar fluid flow channel, wherein said pump body has a proximal end proximal to the input shaft and a distal end distal to the input shaft, an at least one primary inlet port and an at least one primary outlet port and an adjustment cap, said adjustment cap comprised of a threaded outside diameter which is configured to mate with a threaded inside diameter of the pump body. The rotor assembly is comprised of a plurality of rotor disks positioned on a shaft-type rotor wherein each of the rotor disks are alternately positioned in contact between a corresponding stationary stator disk and an at least one body spacer positioned adjacent to the pump body.

The inventive subject matter further includes a method to determine flow rate of a fluid including the steps of: providing a boundary-layer pump comprising: a pump body configured to receive a rotor assembly, the rotor assembly comprised of an input shaft to rotate the rotor assembly and a laminar fluid flow channel, wherein the pump body has a proximal end and a distal end, an at least one primary inlet port and an at least one primary outlet port, adding a fluid to the at least one primary inlet port; rotating the rotor assembly; counting the number of rotations of the rotor assembly and determining the flow rate of the fluid comprising the steps of: detecting pressure at a first absolute pressure sensor; detecting pressure at a second absolute pressure sensor, wherein laminar flow is maintained between the first absolute pressure sensor and the second absolute pressure sensor; detecting temperature and determining the mass flow rate of the fluid.

BRIEF DESCRIPTION OF THE SEVERAL VIEWS OF THE DRAWING

The accompanying figures, which are incorporated in and constitute a part of this specification, illustrate several aspects and together with the description serve to explain the principles of the invention.

FIG. 11A is a performance chart of the rotor and stator disk of FIG. 10A.

FIG. 11B is a performance chart of the rotor and stator disk of FIG. 10B.

DETAILED DESCRIPTION OF THE INVENTION

Figure 1:
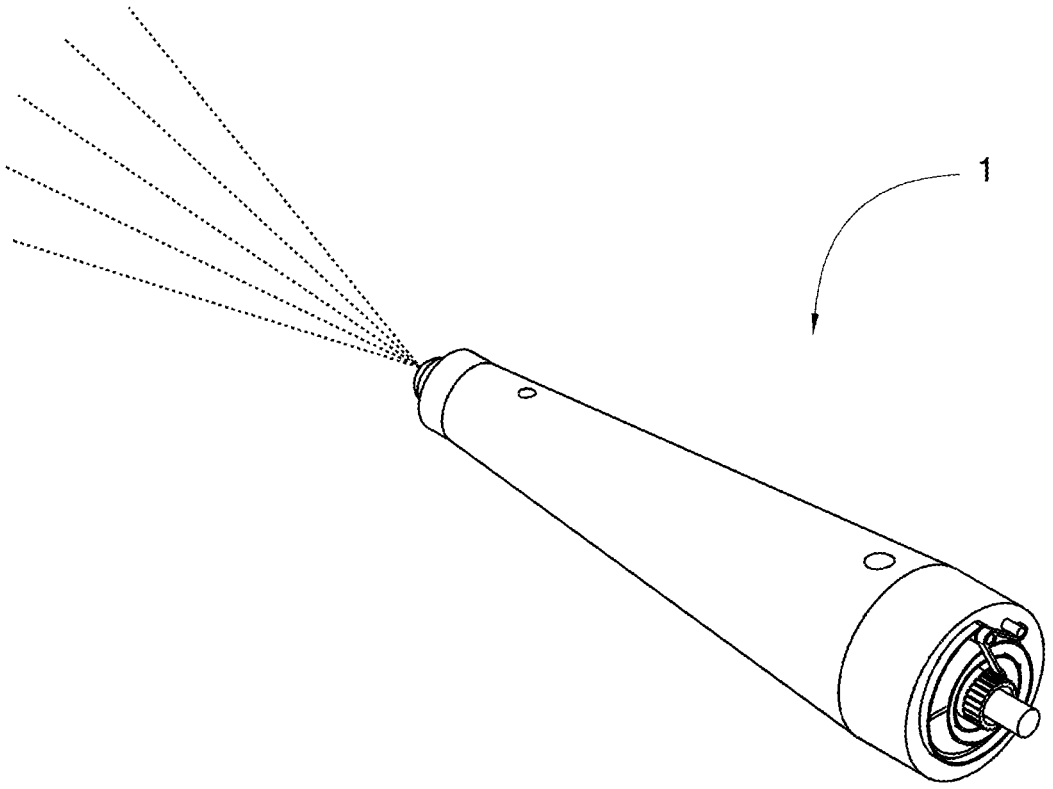
FIG. 1 is a view of a boundary-layer pump apparatus of the present invention.

The present invention can be understood more readily by reference to the following detailed description of the invention and the Examples included therein. Before the present compounds, compositions, articles, systems, devices, and/or methods are disclosed and described, it is to be understood that they are not limited to specific synthetic methods unless otherwise specified, or to particular reagents unless otherwise specified, as such may, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

In the following descriptions, like reference characters designate like or corresponding parts throughout the several views and embodiments. Also, it is to be understood that such terms as "forward," "rearward," "left," "right," "upwardly," "downwardly," and the like are words of convenience and are not to be construed as limiting terms. Locations, shapes, sizes, materials, numbers, relative positions, angular positions, velocities of motion, ranges of motion, electrical tolerances, mechanical tolerances, and other such properties of the devices within the embodiments may be altered and are not to be construed as limiting factors. Nor should the components comprising an assembly be construed as the only suggested components within that assembly. Referring now to the drawings, it will be understood that the illustrations are for the purpose of describing embodiments of the invention and are not intended to limit the invention thereto.

Now referring to FIG. 1 shows the boundary-layer pump 1 dispersing a spray. A boundary-layer pump 1 is a pump in which greater than 20% of the motive force acting upon the fluid is derived from friction between the fluid and a surface of the pump. The boundary-layer pump 1 of this invention is also a continuous-flow pump. A continuous-flow pump is any pump in which the fluid flow path from inlet port to outlet port is uninterrupted by any valve, vane, tooth, lobe, or other obstruction.

Figure 2:
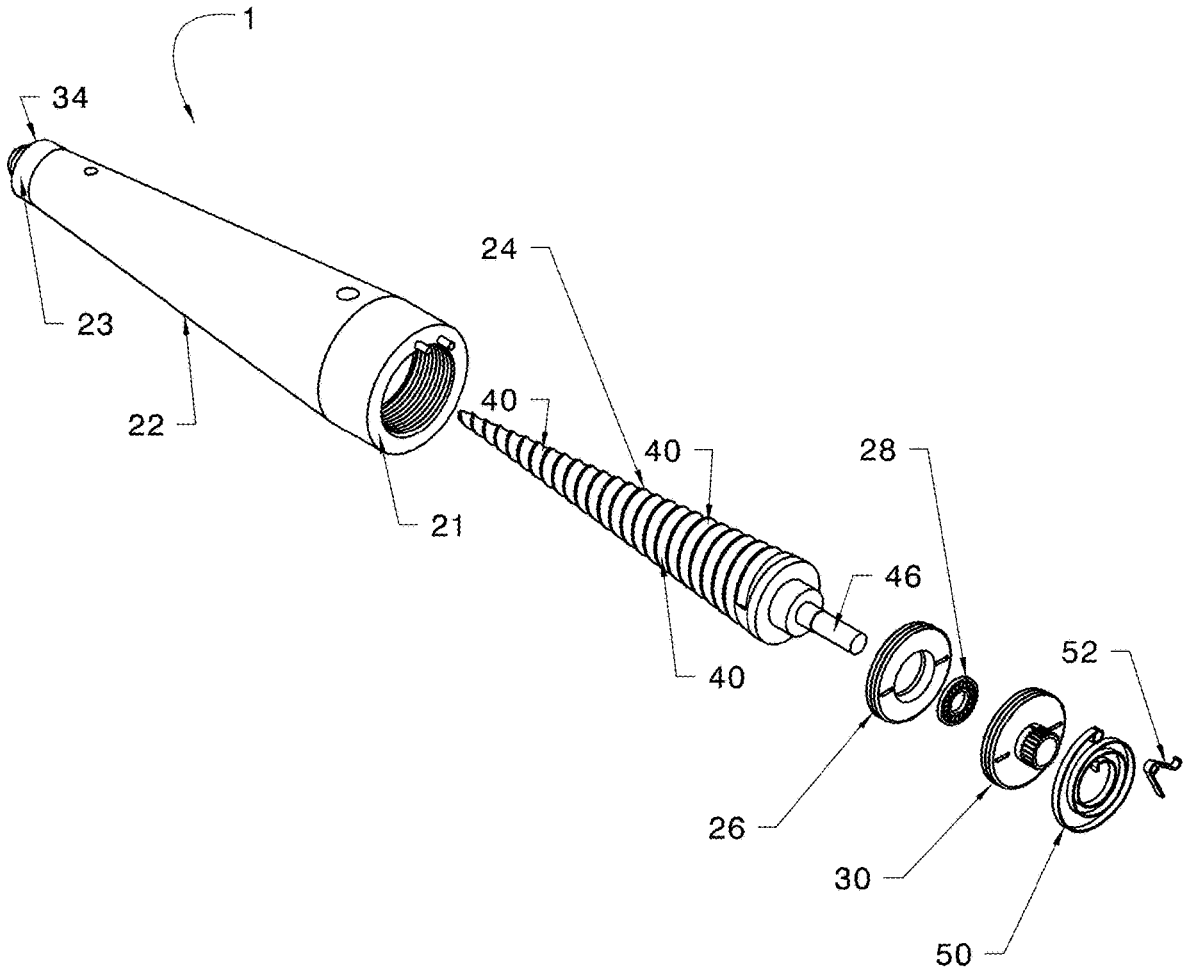
FIG. 2 is an exploded front perspective view of a first embodiment of the present invention.
Figure 3:
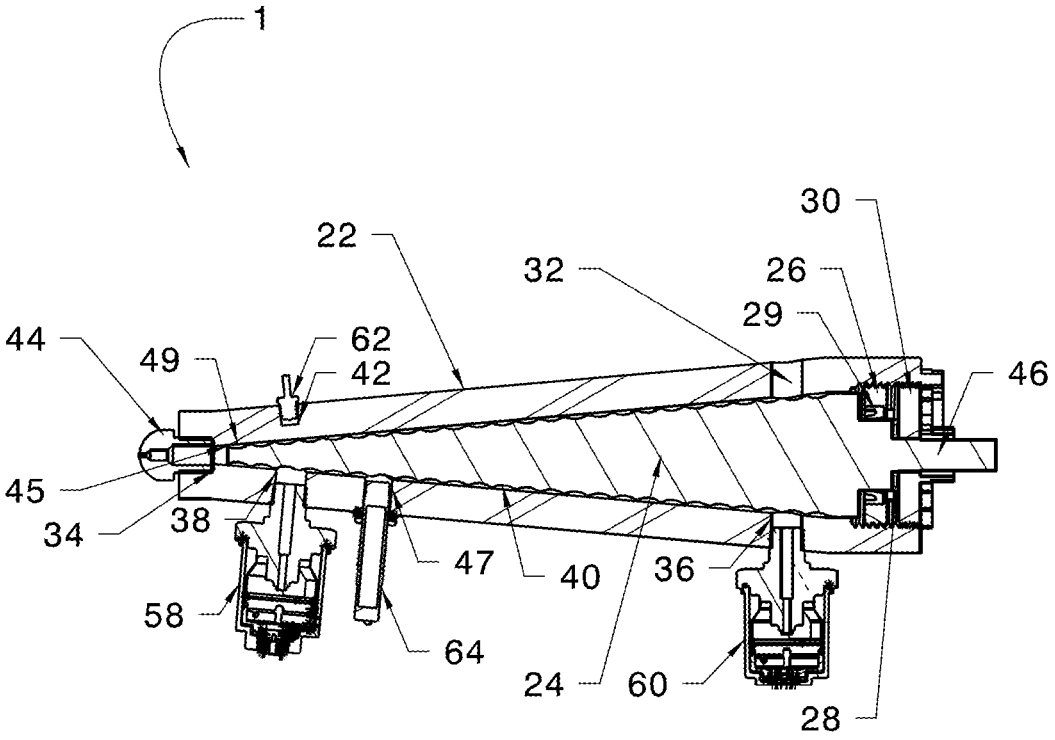
FIG. 3 is a side section view of a first embodiment of the present invention.

Now referring to FIGS. 2-3 is a view of a first embodiment of the boundary-layer pump 1. The view shows a pump body 22. Pump body 22 is a stationary part of a boundary-layer pump 1. In this embodiment, the pump body 22 is generally tapered in shape with the wider end proximal 21 to the input shaft 46 and the narrower end distal 23 to the input shaft 46. The pump body 22 is configured to receive a rotor assembly 24. In this embodiment, the rotor assembly 24 is shown as a screw rotor.

The rotor assembly 24 includes a laminar fluid flow channel 40. A laminar fluid flow channel 40 provides non-turbulent flow for a particular fluid by restricting the depth of the laminar fluid flow channel 40, such that no portion of the fluid flow is outside of the boundary-layer. The laminar fluid flow channel 40 in the rotor assembly 24 is configured to enable flow toward the outlet port 34 while maintaining a Reynolds number (Re) which is preferably below 2000. This measure depends on the particular fluid viscosity and the RPM of the pump in addition to the channel depth. In practice, these practical considerations result in a channel with a width-to-depth ratio generally greater than 5:1. The laminar fluid flow channel 40 is of less than the maximum width and depth necessary to maintain the laminar flow of its intended fluid, which may include machine oils, petroleum, crude oils, paints, protective coatings, additives, dyes, glues, sealants, caulks, slurries, resins, soaps, polishes, syrups, vegetable oils, fruit and vegetable pastes, dairy products, medicines, cosmetics, and many others. The laminar channel 40 shown here has a tapered helix configuration. However, the laminar channel 40 can also have a helix, or spiral configuration.

The length of the laminar fluid flow channel 40 determines the general head pressure capacity of the boundary-layer pump 1. An increased pressure capacity is often a desirable advantage over other pumps and begins to manifest approximately when the laminar fluid flow channel 40 length is greater than 2× the radius of the rotor assembly 24 or greater than five times the square root of the channel's cross-sectional area. The rotor assembly 24 rotates by means of an input shaft 46. The input shaft 46 is a central rotating member of boundary-layer pump 1 driven by a conventional motor (not shown).

The input shaft 46 is sealed by a shaft seal 29, a seal cap 26, a bearing 28 and an adjustment cap 30. The shaft seal 29 and seal cap 26 retains the fluid within the pump body 22. The boundary-layer pump 1 includes an adjustable gap 45 between rotor assembly 24 and pump body 22. The adjustment cap 30 includes a threaded outside diameter which mates with a threaded inside diameter of the pump body 22. By screwing or unscrewing the cap, the gap 45 between the rotor assembly 24 and the opposing wall 49 of the pump body is made variable. The adjustment cap 30 and bearing 28 may retract from the rotor assembly 24 when fluid has high viscosity or additive particles.

At least one primary inlet port 32 and at least one primary outlet port 34 is provided in pump body 22. A spray nozzle 44 is connected to the distal end of the boundary-layer pump 1. A spray nozzle 44 is a precision device that facilitates dispersion of liquid into a spray.

The boundary-layer pump 1 further includes a number of ports for sensors. These sensors include: a low-pressure sensor 60 and low-pressure sensor port 36, a high-pressure sensor 58 and high-pressure sensor port 38, a thermocouple 62 and thermocouple port 42, and a sensor port 47 for any sensor 64 of: temperature, RPM, flow rate, x-rays, ultraviolet, visible light, infrared, video inspection, viscosity, dielectric, or conductivity. It should be noted that an RPM sensor may consist of an integral rotation counter and clock, or these components may be provided individually. From these sensors, one may derive the flow of the pump by the formula: (Rotor Outside Circumference*Channel Cross-Sectional Area*Rotations per Minute*Flow Factor)=(Volumetric Flow per Minute). The volumetric flow may be multiplied by the fluid density to determine mass flow. The Flow Factor is pump and pressure dependent and may be any value from 0 to 1, but a reasonable range for open-flow predictions is 0.14 thru 0.35.

Preferred materials of construction of the pump body 22 and rotor assembly 24 may include hardened stainless steel, hardened tool steel, nitronic, PTFE, or polymer-ceramic, although any suitable material may be used.

Boundary-layer pump 1 operates by continuously drawing fluid into at least one primary inlet port 32, by the rotation of an input shaft 46. The fluid is pumped by the rotor assembly 24 towards the outlet port 34. A continuous-flow pump is a pump in which the fluid flow path 48 (FIG. 7) from at least one primary inlet port 32 to at least one primary outlet port 34 is uninterrupted by any valve, vane, tooth, lobe, or other obstruction. The fluid occupies a laminar fluid flow channel 40 within the rotor that is sufficiently shallow as to maintain non-turbulent fluid flow and boundary layer effect. A boundary-layer pump 1 is any pump having at least one boundary-layer surface which imparts greater than 20% of the kinetic energy to a fluid by means of friction between the boundary-layer surface and the fluid.

The laminar fluid flow channel 40 has a defined cross-sectional area and thus the rotational velocity of the rotor assembly 24 provides precise volume flow metering. Additionally, the placement of an absolute pressure sensor at the low-pressure port 36 and high-pressure port 38 along with a thermocouple at the thermocouple port 42 provides precision mass flow metering, in accordance with Bernoulli's Principle. The variable screw or spiral, while turning, is a pump that is also a precise flow meter. This precision is derived from the extended path length of the fluid against the rotor, which effectively couples the fluid to the rotor and prevents fluid slippage. The pulsation-free, laminar flow is highly uniform from one time interval to the next, even into the millisecond range. The differential pressure between the inlet and outlet ports, the known cross-sectional area of the laminar channel, and the known velocity of the media demonstrate Bernoulli's Principle for flow rate. Pressure ports may be located through the stator walls over the laminar channel. The pressure may be measured by an absolute pressure sensor in an ideal, low-turbulent region affording accuracy and precision of measurement. Further, a temperature sensor may allow for conversion of the volumetric flow information to mass flow information. Multiple orifice or nozzle types built onto or added to the outlet port of the pump may dispense the media in different flow or 'spray' patterns. Adjustment of RPM and of outlet orifices can establish the ideal flow and pressure combination for a particular application. In an example, the flow rate of the fluid can be determined by detecting pressure at a first absolute pressure sensor located adjacent to or within the primary inlet port detecting pressure at a second absolute pressure sensor located adjacent to or within the primary outlet port, wherein laminar flow is maintained between the first absolute pressure sensor and the second absolute pressure sensor; detecting temperature and determining the mass flow rate of the fluid as described above.

The boundary-layer pump 1 can include a spring-loaded or ratcheting auto-tensioner 50 & 52 to compensate for surface wear.

Figure 4:
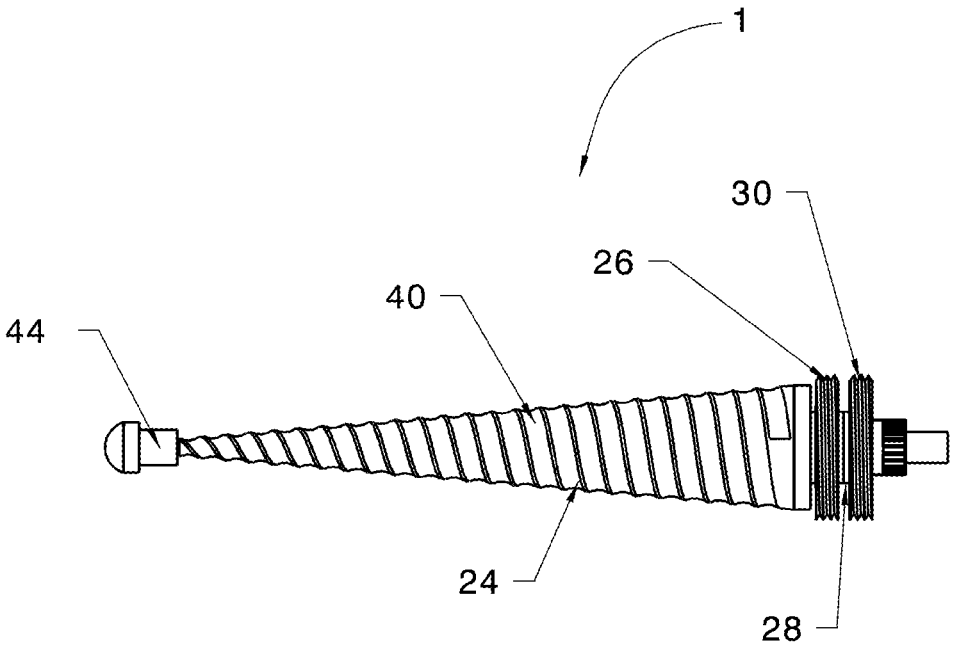
FIG. 4 is a side view of the rotor, nozzle, adjustment cap and seal cap.

Now referring to FIG. 4 is a side view of a first embodiment of the boundary-layer pump 1. The view includes a rotor assembly 24, an adjustment cap 30, thrust bearing 28, seal cap 26, and a laminar fluid flow channel 40. This laminar fluid flow channel 40 in the rotor assembly 24 enables flow toward a nozzle 44 while providing smooth fluid alignment. Any spray nozzle 44 for a particular application can be attached to the boundary-layer pump 1.

Figure 5:
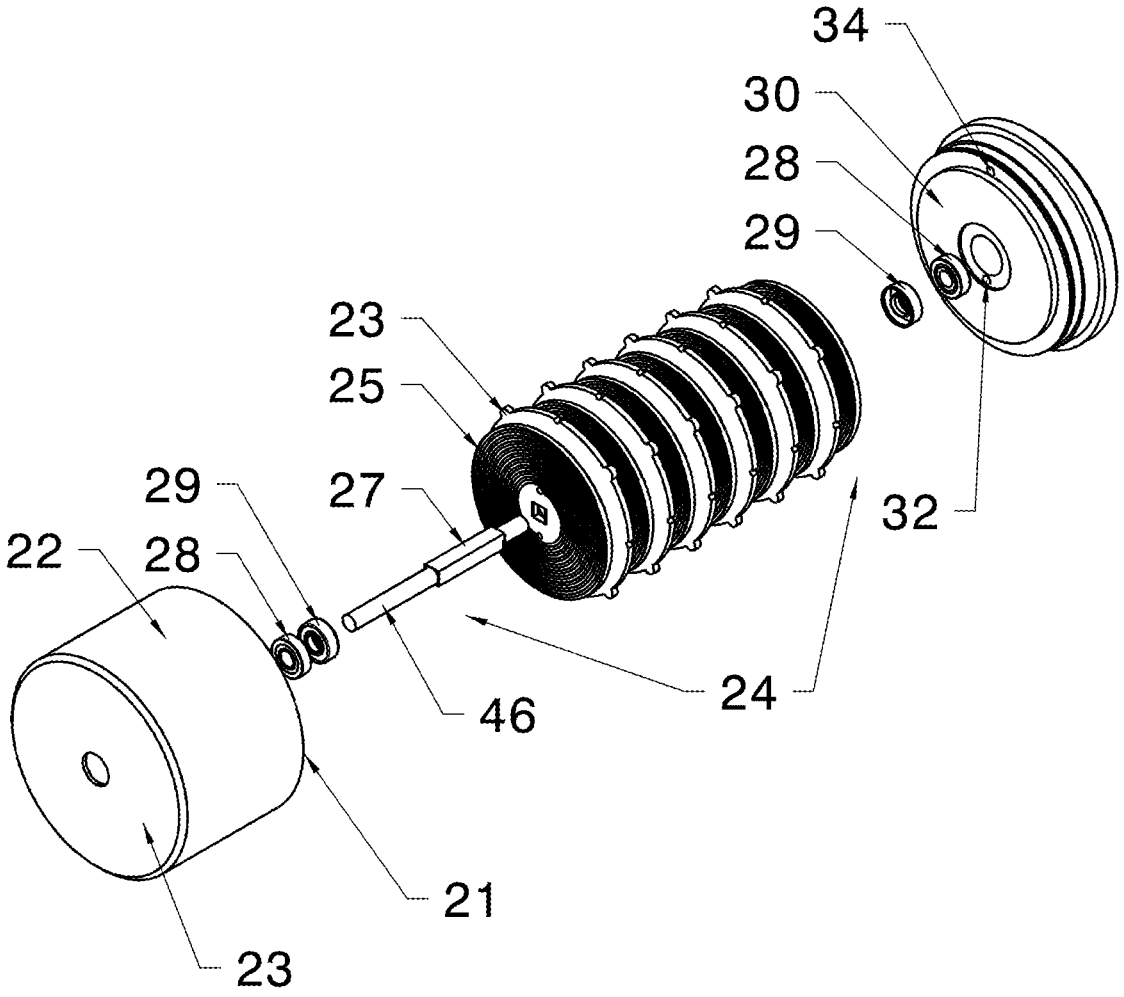
FIG. 5 is an exploded front perspective view of a second embodiment of the present invention.
Figure 6:
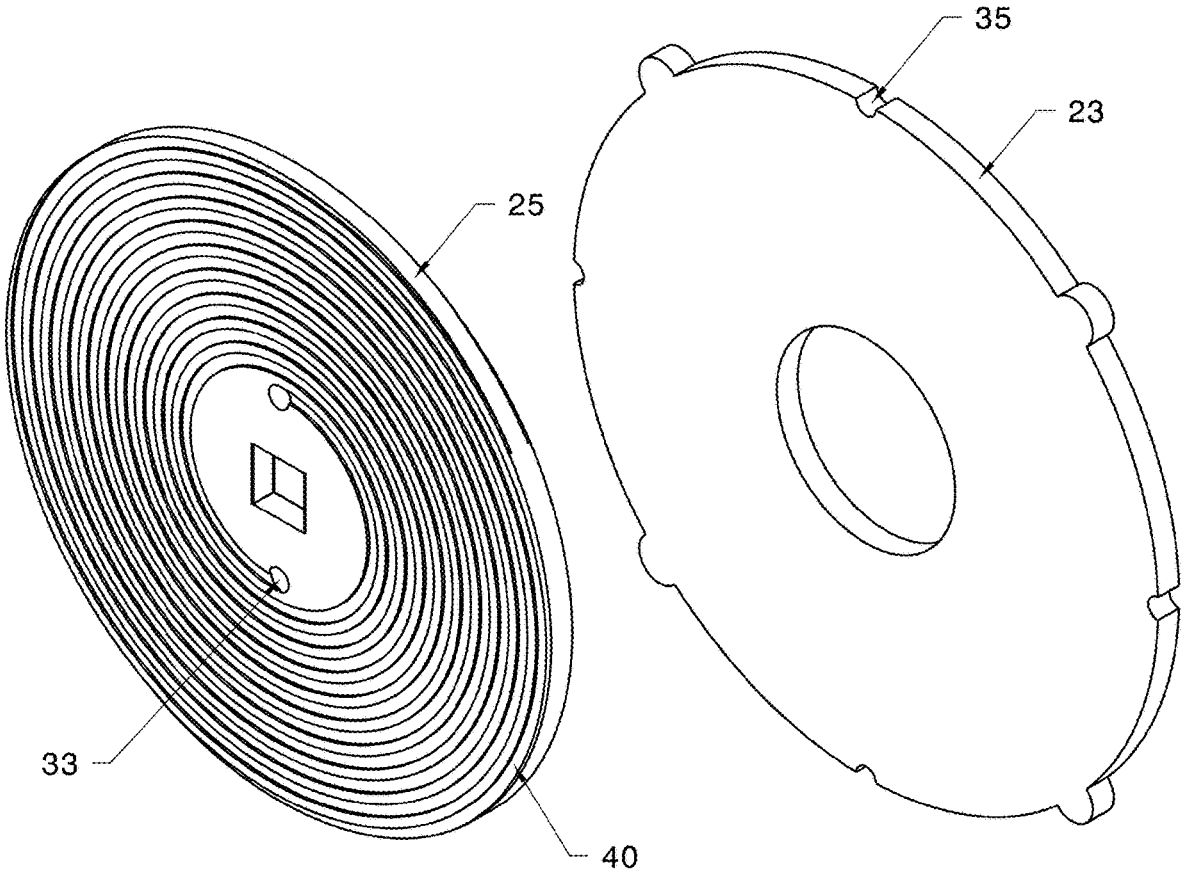
FIG. 6 is a detailed front perspective view of the rotor disk and stator disk of FIG. 4.
Figure 7:
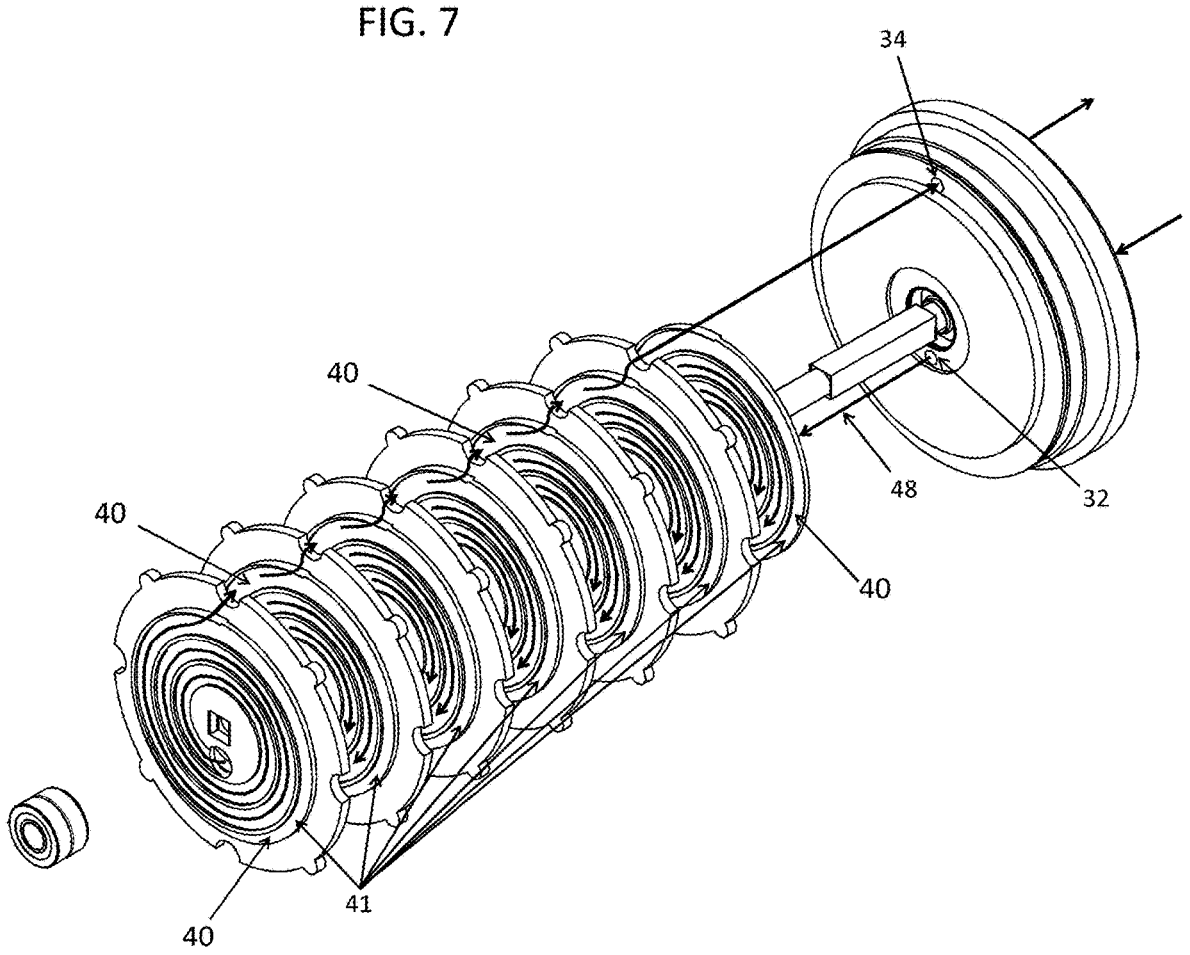
FIG. 7 is an exploded front perspective of the disk stack illustrating the fluid flow vectors.

Now referring to FIGS. 5-7, a second embodiment of the boundary-layer pump 1 is shown. In this embodiment, a rotor assembly 24 is made of a plurality of rotor disks 25 on a common shaft-type rotor 27. Each of the rotor disks 25 is alternately positioned between a corresponding plurality of stator disks 23, with the stator disks 23 rendered incapable of rotation by their coupling to a pump body 22. In this embodiment, each rotor disk has at least one laminar fluid flow channel 40 arranged in the general form of an Archimedean spiral. The plurality of rotor disks 25 are organized in a stack. The stack is a coaxial alternating arrangement of rotor disks and stator disks 23, which when arranged in parallel flow does increase the effective cross-sectional area of laminar fluid flow channel 40, and when arranged in series increases the effective length of laminar fluid flow channel 40, without sacrificing the boundary layer effects on the fluid.

On each end of rotor 27 is a bearing 28 and shaft seal 29, which allow free rotation of the rotor assembly 24 and prevent fluid from leaking out of the boundary-layer pump 1, respectively. In an adjustment cap 30, and at least one primary inlet port 32 and an at least one outlet port 34, provides the primary ingress and egress of fluid to the boundary-layer pump 1. Fluid flow is communicated from at least one primary inlet port 32 through the laminar fluid flow channel 40 before recombining and exiting through the outlet port 34.

In this embodiment, the laminar fluid flow channel 40 includes an at least one secondary inlet port 33 positioned on each of the rotor disks 25, the at least one secondary inlet port 33 configured to allow fluid communication to the plurality of rotor disks 25. An at least one secondary outlet port 35 is positioned on each of the stator disks 23 configured to allow fluid communication to the at least one primary outlet port 34. More specifically, the rotor disks 25 is made of a set of at least one axial secondary inlet port 33 that allows fluid communication to a plurality of rotor disks 25, with all rotor disks 25 producing flow in parallel through at least one laminar fluid flow channel 40. The flows exit each disk of the plurality of rotor disks 25 at the periphery and may combine to pass through at least one secondary outlet port 35.

In this embodiment, the fluid flow is communicated from the at least one primary inlet port 32 through the secondary inlet ports 33 of each rotor disk 25, and in parallel through the laminar fluid flow channel 40 of each rotor disk 35, before recombining and exiting through the secondary outlet port 35 and at least one primary outlet port 34.

Figure 8:
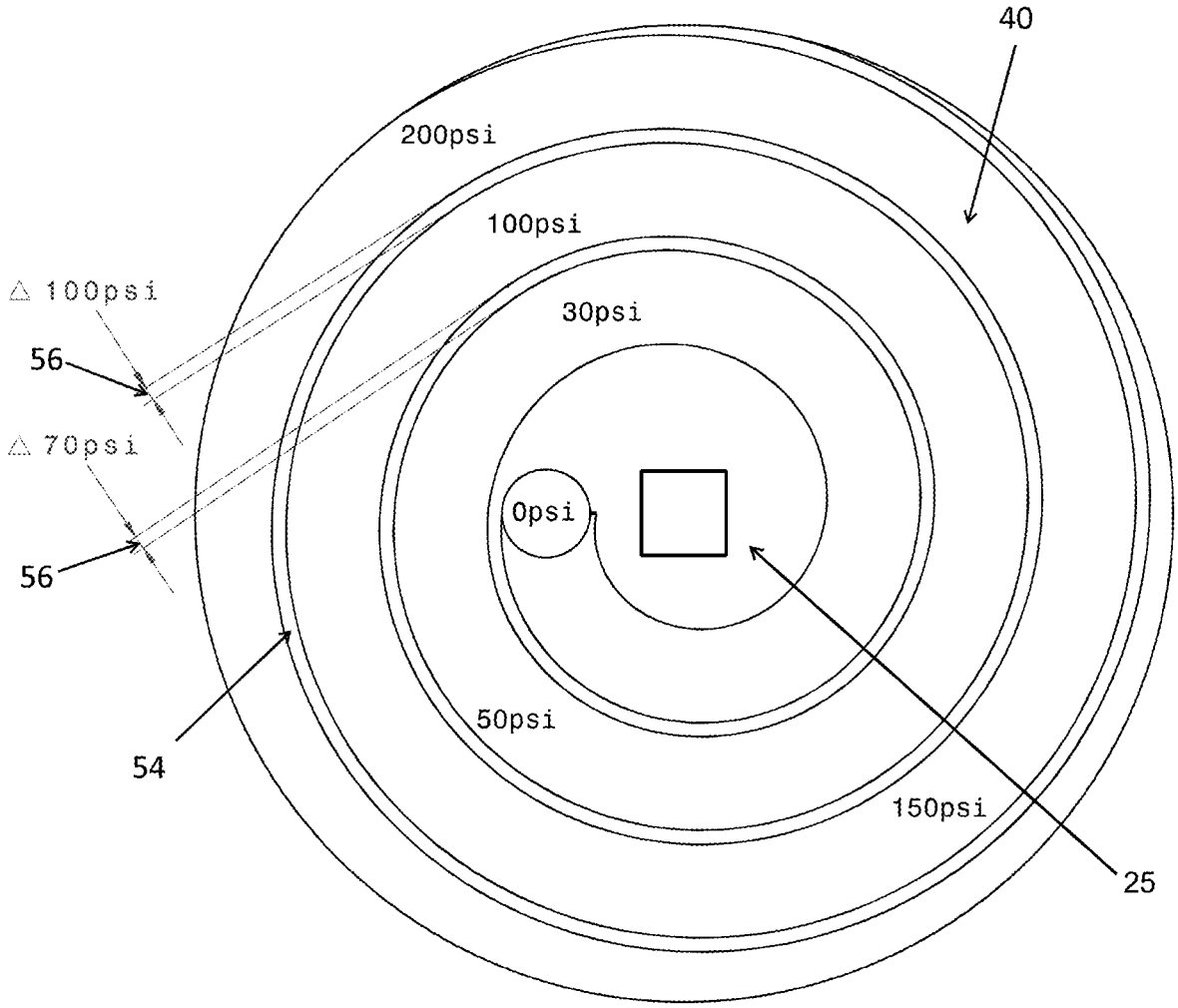
FIG. 8 is a front schematic view of the rotor disc, illustrating absolute and differential pressures.

Now referring to FIG. 8 is a front schematic view of a rotor disk 25 illustrating absolute and differential pressures. For example, at an absolute pressure of 200 psi, the fluid increases from 0 psi in a substantially linear fashion throughout the length of the channel. A pressure differential develops between the spiral turns of the laminar fluid flow channel 40, and the channel face seal 54 of the rotor must endure this delta pressure 56.

Now referring to FIGS. 5-8, a boundary-layer pump 1 operates by continuously drawing fluid into the at least one primary inlet port 32 by the rotation of an input shaft 46. The fluid is pumped by the rotor assembly 24 towards the outlet port 34. A continuous-flow pump is a pump in which the fluid flow path 48 (FIG. 7) from at least one primary inlet port 32 to outlet port 34 is uninterrupted by any valve, vane, tooth, lobe, or other obstruction. The fluid occupies a laminar fluid flow channel 40 within the rotor disk that is sufficiently shallow as to maintain non-turbulent fluid flow and boundary-layer effect. A boundary-layer pump 1 is any pump having at least one boundary-layer surface which imparts greater than 20% of the kinetic energy to a fluid by means of friction between the boundary-layer surface and the fluid. An adjustment cap 30 and bearing 28 may retract from the rotor when fluid has high viscosity or additive particles. A shaft seal 29 or seal cap 26 retains the fluid within the pump body 22.

Figure 9:
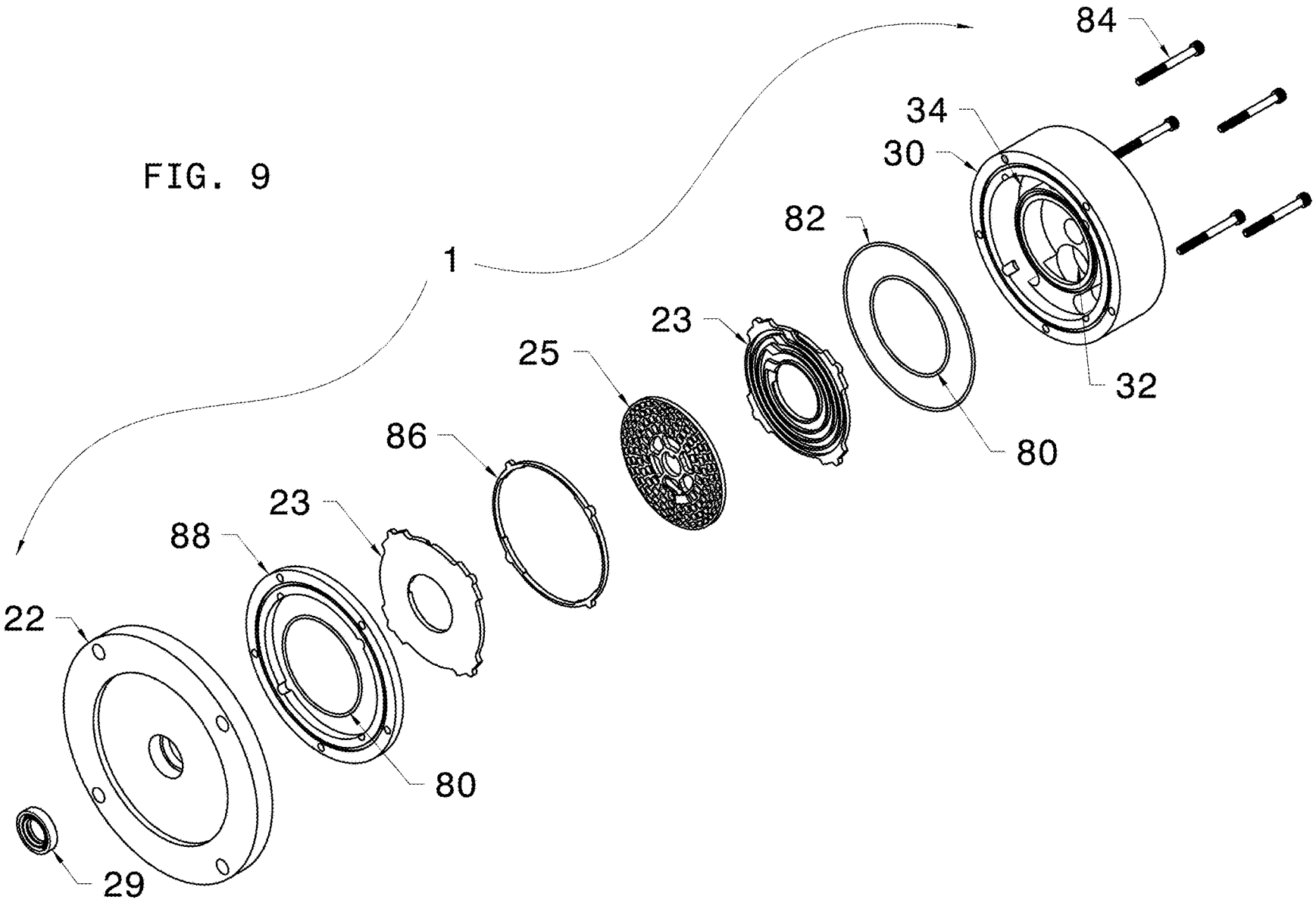
FIG. 9 is an exploded front perspective view of a third embodiment of the present invention.

Now referring to FIG. 9, a third embodiment of the boundary-layer pump 1 is shown. This embodiment includes a pump body 22 and an adjustment cap 30, which house the internal components while providing an inlet port 32 and outlet port 34. Shaft seal 29 allows insertion of a keyed motor shaft (not shown) and prevents fluid leakage. At least one disk seal 80 prevents unwanted fluid flow from outlet to inlet, while an at least one body seal 82 prevents unwanted fluid leakage to the exterior of the pump, with each seal being of a soft, pliable material such as rubber.

In this embodiment, an at least one rotor disk 25 is alternately positioned between a corresponding plurality of stator disks 23, with the stator disks 23 are stationary and are rendered incapable of rotation by their coupling to the pump body 22, the adjustment cap 30 or to a body spacer 88. A body spacer 88 is configured to increase the internal volume of the pump, with the increase in volume being filled by at least one rotor or stator disc. The body spacer in one exemplary embodiment is substantially ring shaped and position between the pump body 22 and a stator disk 23. By addition or subtraction of body spacers 88, the distance between the pump body 22 and the adjustment cap 30 is made variable in increments, to accommodate greater or lesser numbers of rotor disks 25 and stator disks 23. By tightening or loosening an at least one adjustment screw 84 the distance between the pump body 22 and the adjustment cap 30 is made variable within a small continuous range while compressing or expanding the at least one body seal 82. An at least one disk spacer 86 is provided to limit the extent by which the at least one adjustment screw 84 may be tightened. The adjustment screw 84 may be integral or in addition to the adjustment cap 30. It is intended that this disk spacer 86 should be of the same thickness as the rotor 25, or very slightly thicker, and may be fabricated from the exact same piece of raw material as the rotor disk 25. By this construction, the spacing between the rotor disks 25 and stator disks 23 may be 0.000" or very slightly greater, with a preferred range between 0.000" and 0.010". If the disk spacer 86 provided is of the exact same thickness as the rotor disk 25 then it is expected that the boundary-layer pump 1 will require a break-in period, including the steps of: One. Assembling the boundary-layer pump 1 with adjustment screws 84 loosely threaded into the pump body; 22; Two. Coupling the boundary-layer pump 1 to an appropriate motor; Three. Providing rotation from the motor to the rotor disk 25; Four. Slowly tightening the adjustment screws 84 until the rotor disk 25 and stator disk 23 have worn to allow free rotation without binding and the screw load bears upon the disk spacers 86. This process may be aided by the addition of lubricants or fluid abrasives.

Figure 10A:
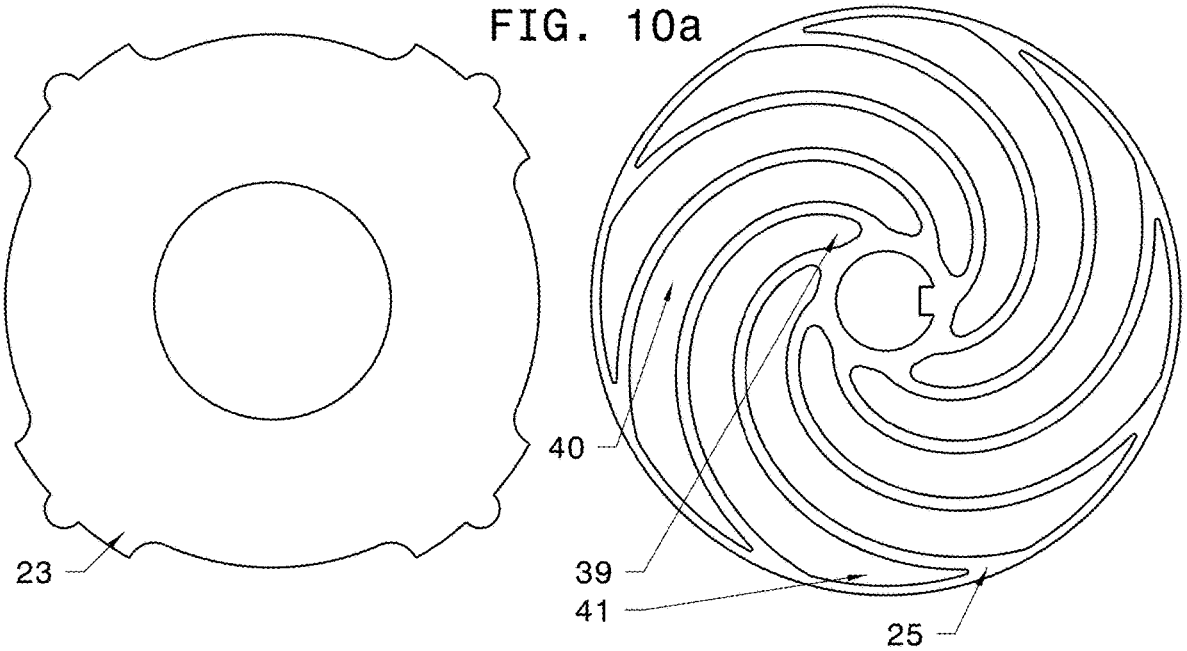
FIG. 10A is a front view of the rotor and stator disc, optimized for pumping efficiency.

Now referring to FIG. 10A, a particular embodiment of rotor disk 25 includes a plurality of laminar fluid flow channels 40, which may be pocketed into or perforated through the face of rotor disk 25. The pitch of the channels is such that the total cross-sectional area of channel is maximized (within the constraints of material strength) at a channel inner radius 39, and the width of the channel remains substantially constant in its progression to a channel outer radius 41. The pitch (centerline distance between subsequent spiral turns of a particular channel) is therefore equal to the circumference represented by the inner radius of the channel (Pitch=2π*Inner Radius). This spiral pitch is herein recognized as the pitch of highest efficiency, and it should be noted that any pitch within +/−50% of this value is regarded as being substantially the same. In this embodiment, the stator disk 23 is smooth faced and may include materials or surface coatings to improve smoothness or reduce fluid adhesion, such as glass, ceramic, or PTFE. This configuration of rotor disk 25 and stator disk 23 produces an abundance of flow with acceptable pressure characteristics as illustrated in FIG. 11A.

Figure 10B:
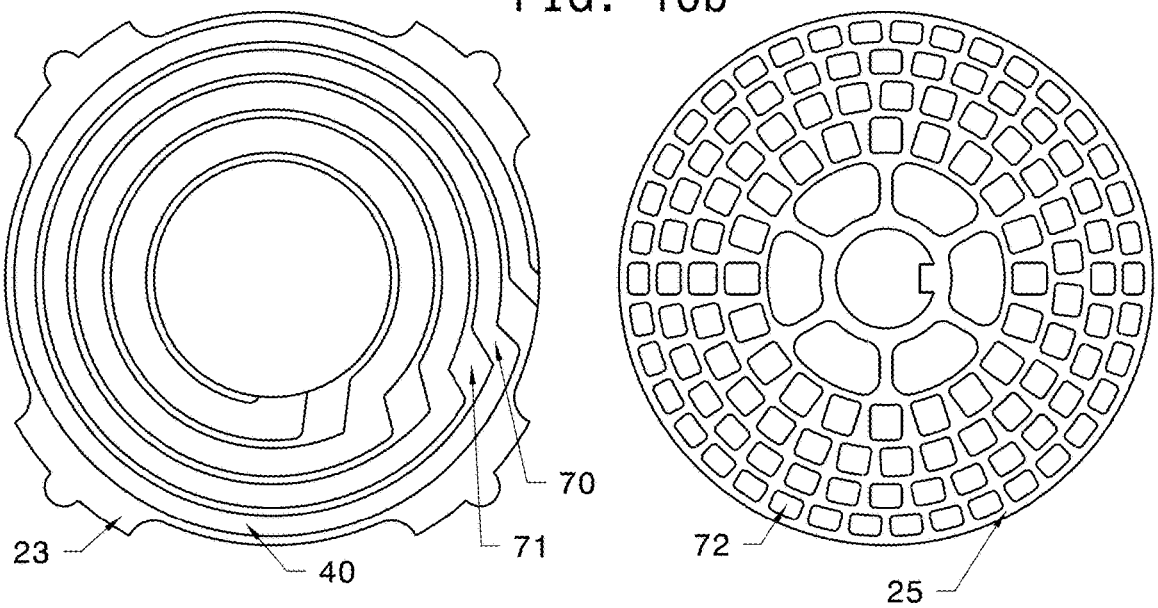
FIG. 10B is a front view of the rotor and stator disc, optimized for pressure capacity.

Now referring to FIG. 10B, a front view of the rotor disk 25 and stator disk 23, optimized for pressure capacity, is shown. In this embodiment, the stator disk 23 includes an annular, self-concentric, laminar fluid flow channel 40 which includes transfer jogs 70 to pass flow from one channel ring to the next. These transfer jogs 70 may be applied equally well to cylindrical or conical rotors and stators. These transfer jogs 70 may preferentially be at 45 degrees to the direction of the channel rings, or may be at angles substantially steeper or shallower, or may include arcs, scoops, vanes, or other features for maintaining fluid inertia. In conjunction with the transfer jogs 70 are an at least one channel interrupt 71 which connects the sealing surfaces of one channel ring to the next. The rotor disk 25 includes drag surfaces 72 which may be holes pocketed into or perforated through the disc, or which may be ridges, indentations, or vanes of any arrangement upon a cylindrical, conical, or disc-shaped rotor or stator. An arrangement of this sort will produce exceptional fluid pressures with reasonable flow as illustrated in FIG. 11B.

Now referring to FIG. 11A, a performance chart of a boundary-layer pump 1 using a rotor disk 25 of the configuration in FIG. 10A, is shown. In this particular example, the single 3.6" diameter rotor disk 25 was coupled to a 1 hp nameplate three-phase motor, powered by a variable frequency drive. The pump ran at four unique speeds, and pressure was modulated by a flow restriction valve.

Now referring to FIG. 11B, a performance chart of a boundary-layer pump 1 using a rotor of the type in FIG. 10B, is shown. In this particular case, the single 3.6" diameter rotor disk 25 was coupled to a 1 hp nameplate three-phase motor, powered by a variable frequency drive. The boundary-layer pump 1 ran at four unique speeds, and pressure was modulated by a flow restriction valve.

Figure 12:
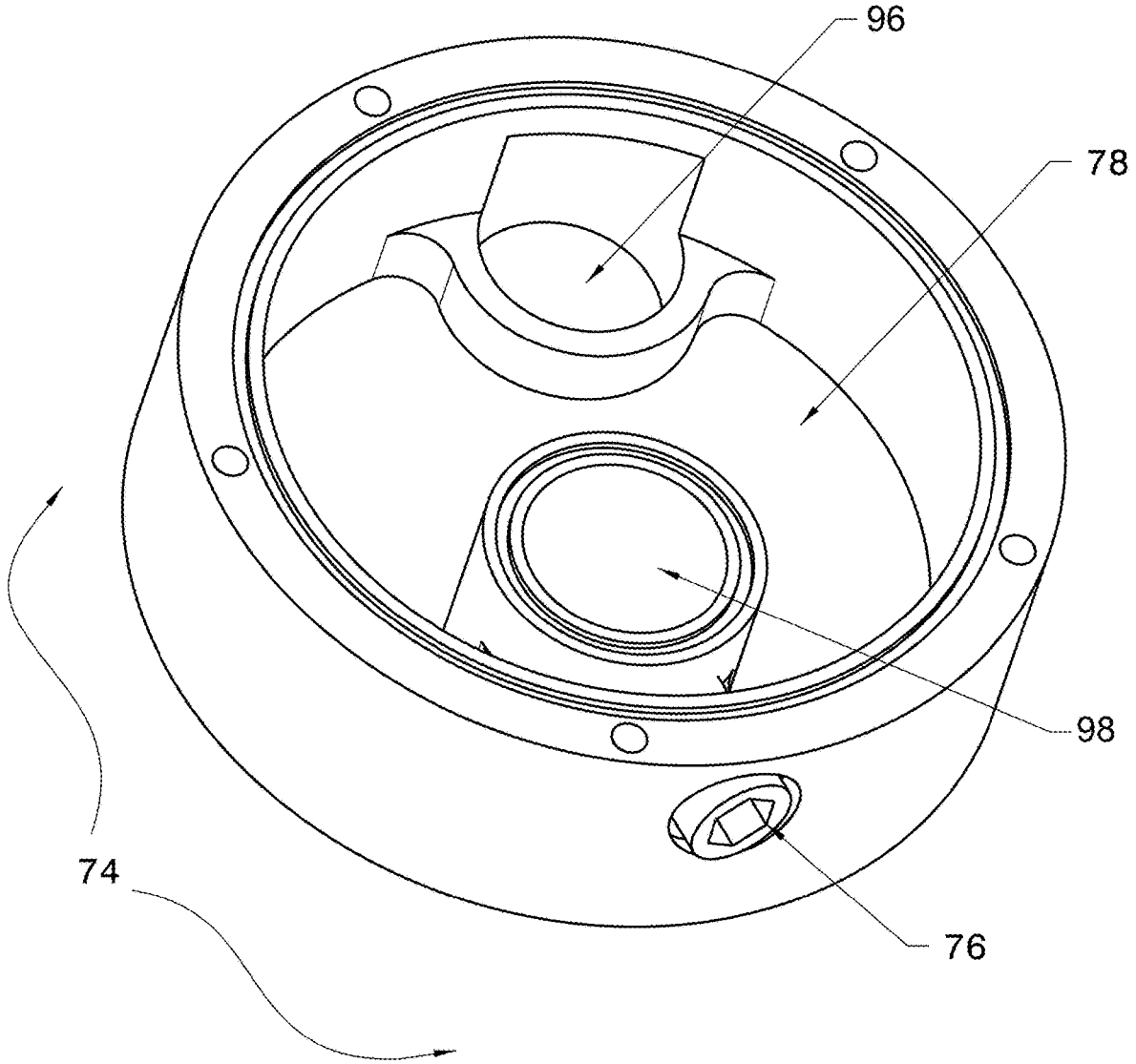
FIG. 12 is a bottom isometric view of an add-on priming module.

Now referring to FIG. 12, a priming module 74 couples and seals against the adjustment cap 30 of FIG. 9. This optional bolt-on accessory provides a reservoir 78 which holds a volume of liquid to be pumped. A priming inlet 98 couples and seals against the inlet port 32 of the adjustment cap 30. Priming outlet 96 allows fluid discharge from the reservoir. A priming valve 76 fluidly connects or disconnects the priming inlet with the reservoir. When the priming valve is open and boundary-layer pump 1 is running, the fluid contents of the reservoir flow in circuit, while entraining air from the priming inlet and allowing the pump to draw from a fluid source below the elevation of the pump. The entrained air is discharged from the priming outlet until the supply lines are emptied of air and the boundary-layer pump 1 is fully primed. At this time, the priming valve may be closed and the boundary-layer pump 1 resumes normal operation.

Figure 13A:
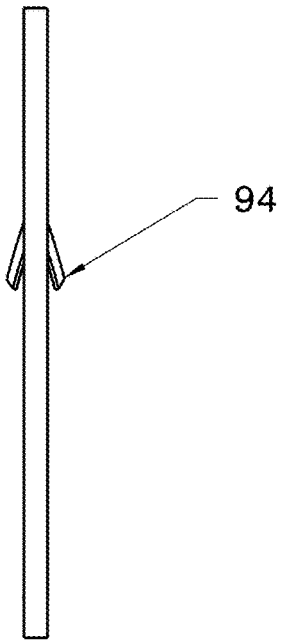
FIG. 13A is a side isometric view of a rotor disk with priming tab.
Figure 13B:
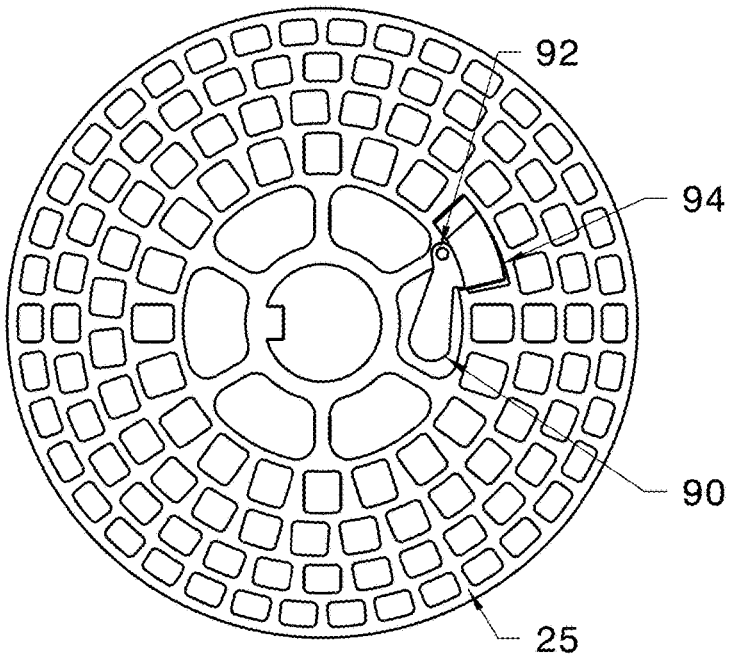
FIG. 13B is a front view of a rotor disk with priming tab.
Figure 13C:
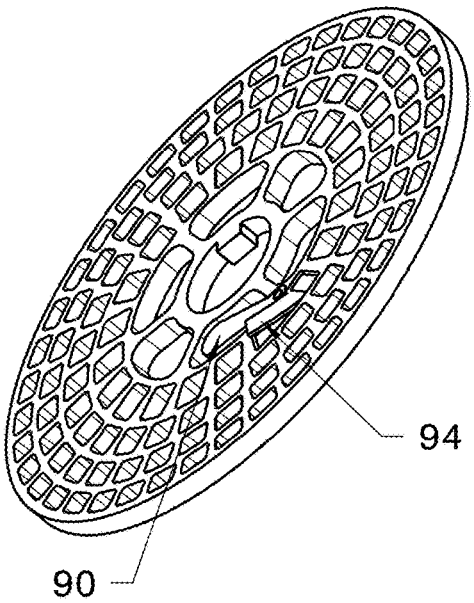
FIG. 13C is an isometric view of a rotor disk with priming tab.

Now referring to FIGS. 13A-13C, the rotor disk 25 or stator disk 23 (FIG. 10B) may be fitted with an at least one priming tab 94 which may be a piece of spring steel or other flexible sheet and may further include soft sealing materials such as rubber. The priming tab 94 may be flat or curved and may flex at one or multiple points of articulation. The priming tab 94 may travel within one or more of the laminar fluid flow channels 40 (FIG. 10B). In operation, the priming tab 94 seals the channel and sweeps air from inlet to outlet. When the tab encounters channel interrupt 71 (FIG. 10B), it flexes out of the way and rides over the face of the interrupt until it reaches the other side, then returns to its position within the channel. Thus, the boundary-layer pump 1 may self-prime and draw from a fluid source below the elevation of the pump.

The priming tab 94 may further include a priming latch 90 which may be a weighted latch which articulates upon a latch pivot 92. At low RPMs, the priming latch remains disengage from the priming tab, allowing it to function as previously described. At high RPMs, centrifugal force causes the priming latch to engage against the priming tab, locking it against the rotor, and preventing the priming tab 94 from wearing against the channel interrupt.

Figure 14A:
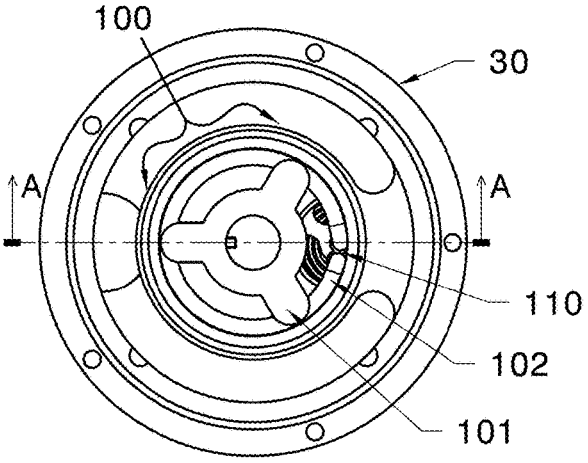
FIG. 14A is a front view of an adjustment cap with an auxiliary priming pump.
Figure 14C:
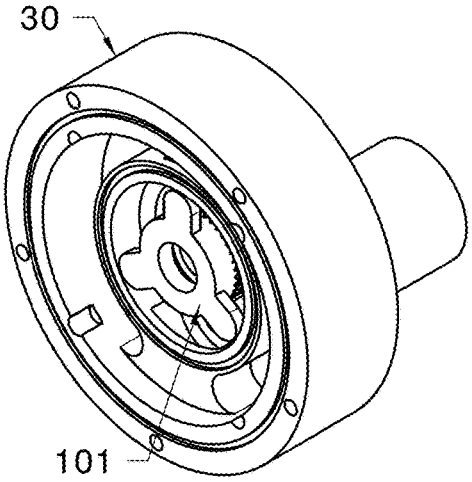
FIG. 14C is an isometric view of an adjustment cap with an auxiliary priming pump.
Figure 14B:
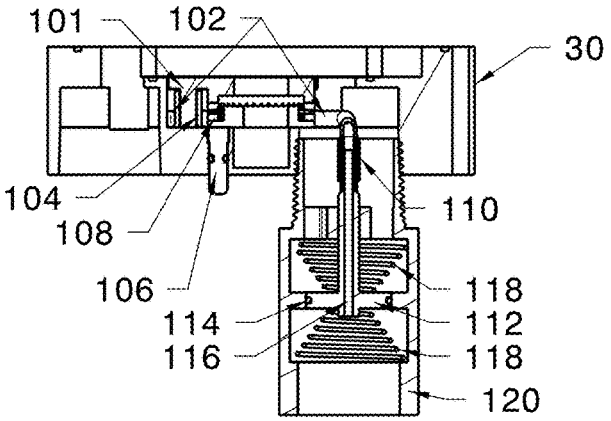
FIG. 14B is a sectional view of an adjustment cap with an auxiliary priming pump taken at A-A.

Now referring to FIG. 14A-14C, in which FIG. 14B is a section view A-A of FIG. 14A and FIG. 14C is an isometric view of FIG. 14A, the adjustment cap 30 may further include a priming pump 100. In this embodiment, priming pump 100 is made of a priming rotor body 101 with an at least one roller 104. The at least one roller 104 is configured to compress and thereby constrict a flexible tube 102. By rotation of the priming rotor body 100, at least one roller 104 may progressively move a volume of air or fluid through the flexible tube 102. The flexible tube 102 may extend to a fluid source or may induce fluid into the priming pump 100 by creation of a vacuum. The priming pump 100 may further include a clutch disk 108 and a clutch button 106. The clutch disk 108 may be keyed to a motor shaft (not shown) in such a manner that the clutch disk 108 rotates with the shaft but may slide axially along the shaft. By depressing the clutch button, clutch disk 108 may be forced into contact with the priming rotor body 100, thereby engaging the priming rotor body 101 into rotation with the motor shaft. The clutch disk 108 and priming rotor body 101 may include teeth, protrusions, pads, or other friction surfaces to improve engagement properties.

The priming pump 100 may optionally include a suction valve 120. This suction valve 120 may be threaded into the inlet or outlet of the adjustment cap 30 or may be integral with the adjustment cap 30 or the pump body 22 (FIG. 9). The suction valve 120 may include a suction plunger 112 which forms an airtight seal against the suction valve 120 by means of a suction seal 114. At rest, and at least one suction valve spring 118 holds the suction plunger 112 in a position of sealing contact with the suction valve 120. The suction plunger 112 may slide axially in either direction from its rest position, thereby breaking the airtight seal and allowing fluid flow either forward or backward but preventing flow or backflow at insufficient pressure. The suction plunger 112 may include a priming port 116 to which the flexible tube 102 is connected. The flexible tube ends may be held rigidly in place by a tube bracket 110.

In operation, the user supplies rotation to the pump and depresses the priming button. This engages the priming pump, pulling air from the fluid supply line. When the air is evacuated from the supply line, fluid fills the internal cavities of the pump and becomes driven by at least one rotor disk 25 producing pressure or negative pressure in the suction valve 120. This pressure causes the suction plunger to pop open and allow normal fluid flow. The priming button may then be released, disengaging the priming clutch disk. When the pump is halted, the plunger closes to maintain priming within the pump. When the pump rotation is reversed, the fluid forces the plunger open in the opposite direction, allowing the fluid to backflow to the source.

Figure 15:
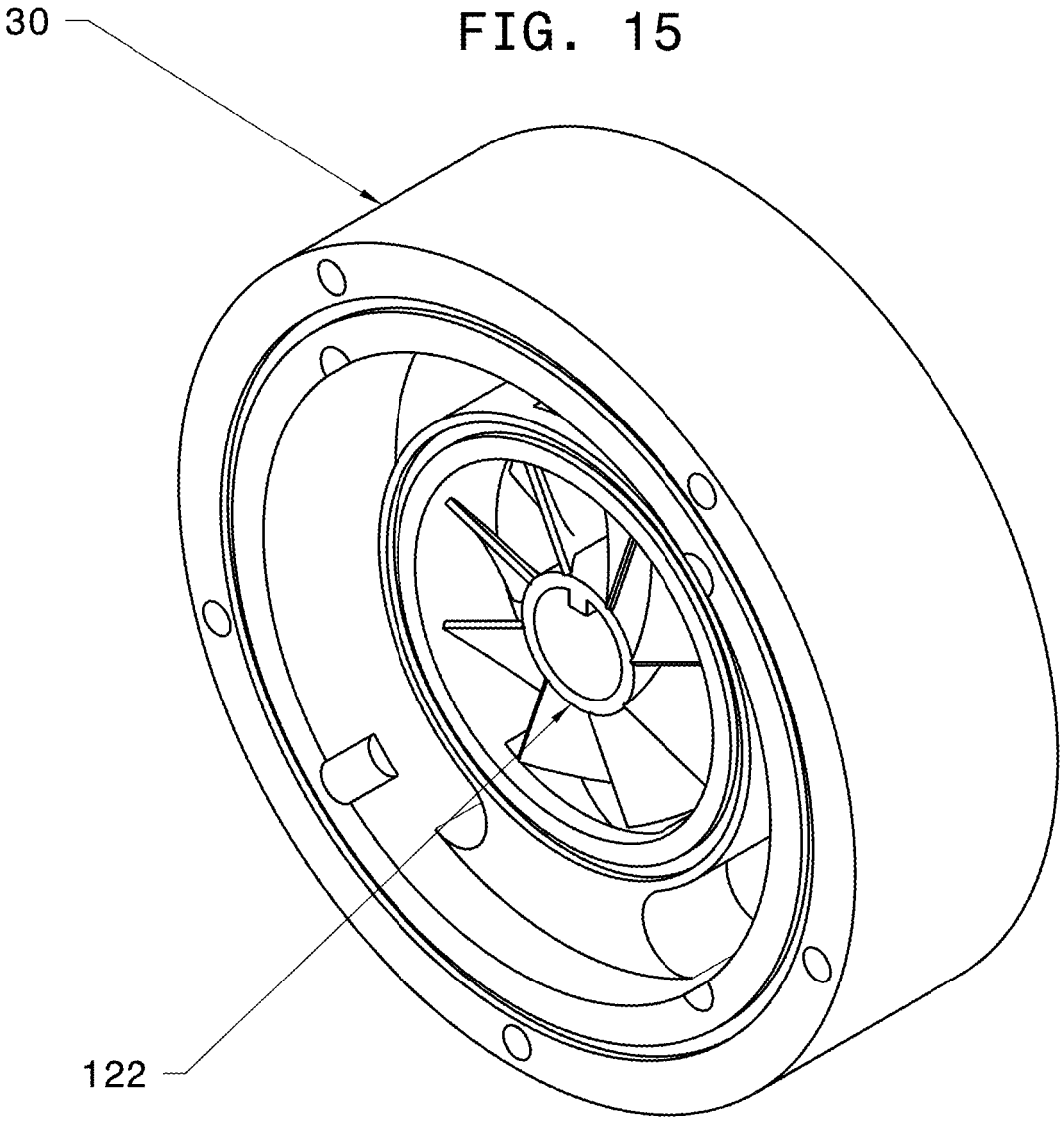
FIG. 15 is an isometric view of an adjustment cap with an auxiliary priming fan.

Now referring to FIG. 15, the adjustment cap 30 or pump body 22 may further include a priming fan 122, which may be an axial, impeller, toroidal, squirrel-cage, or any other fan. This priming fan 122 may be driven directly by the motor shaft or through a gearbox or may be indirectly driven through a selective clutch. In operation, this priming fan 122 is configured to produce a negative pressure with respect to the supply line, pulling air from the supply line, and lifting fluid from a supply below the elevation of the boundary-layer pump 1.

Figure 16:
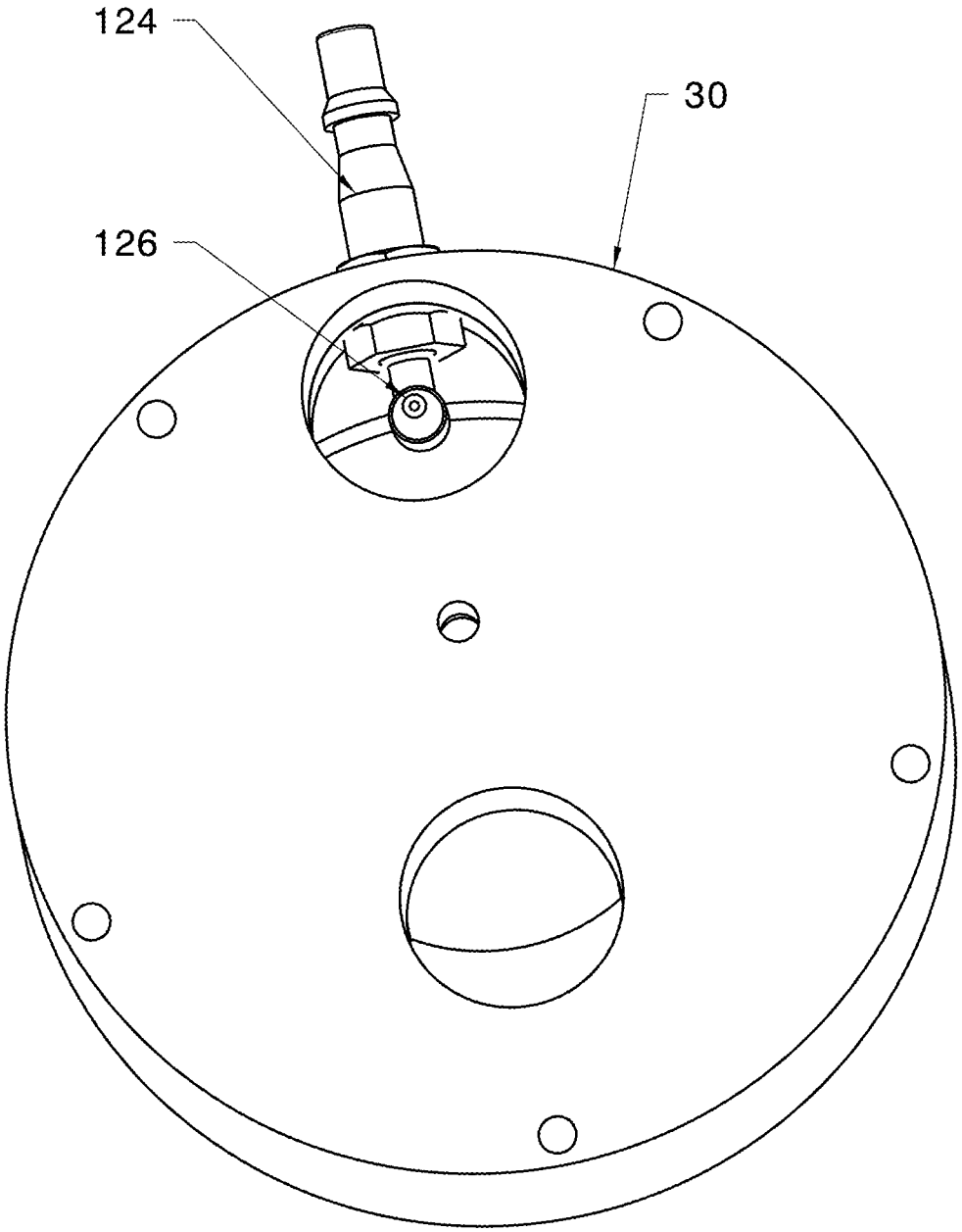
FIG. 16 is an isometric view of an adjustment cap with a priming eduction nozzle.

Now referring to FIG. 16, the adjustment cap 30 or pump body 22 may further include an eduction nozzle 126 which may be a simple orifice, conical nozzle, shrouded nozzle, or any other form of nozzle. The eduction nozzle may connect to a source of compressed gas by means of an air connector 124 which may be a straight tube, threaded port or nipple, quick-connect fitting, or any other form of connector. The connector may include manual or electronic valves to halt gas flow. In operation, nozzle 126 supplies high velocity gas into the outlet line of the pump. By Bernoulli effect, the gas produces an area of low pressure, educing fluid from a source below the elevation of the boundary-layer pump 1. The embodiments of the present invention provide a unique, variable, laminar-channel rotor nesting in a stator that can be tightened or loosened from the stator, changing the effective cross-sectional area of the channel interface. The pump maintains low Reynold's numbers in the rotor channel thus also being a precision fluid volume and mass flow meter that is comparably simple to manufacture. Materials being pumped are not damaged by pumping action.

The boundary-layer pump 1 can be assembled with adjustment screws loosely threaded into the pump body; coupling the boundary-layer pump 1 to an appropriate motor; providing rotation from the motor to the pump rotor; and slowly tightening the adjustment screws until the rotor and stator have worn together and the screw load bears upon disk spacers.

Many other variations are possible. For example: although the embodiments illustrate particular geometries of the outlet port and associated spray nozzle, any configuration of outlets or spray nozzles can be used. The inlet or outlet may include a check valve or other valve type. Although the embodiments illustrate particular geometries for helical or spiraling laminar channels, any number, shape, proportion, or cross-sectional area may be used, providing laminar or non-laminar flow. Although the embodiments illustrate a laminar channel upon a rotor, the laminar channel may alternately or additionally be upon the stator. Although the embodiments illustrate particular geometries of adjustment cap, the variable channel cross-sectional area adjustment can be performed by any other means, such as a channel shim or channel spring. The adjustment feature may include a spring-loaded or ratcheting auto-tensioner to compensate for wear. The adjustment feature may be removed altogether and the gap distance may be fixed. Although the embodiments suggest rotor and stator materials of hardened stainless steel, any suitable material, including but not limited to tool steel, other metals, ceramic, glass, plastic, synthetic, or composite, may be used. Materials such as Nitronic, PTFE, carbon fiber, Kevlar, and polymer-ceramic composite are of particular interest. Soft-sealing materials such as rubber, neoprene, silicone, and the like may be used at any sealing surface. Although the embodiments show thrust bearings and ball bearings on the rotor, other types of bearing may be used, including but not limited to bushings, journal bearings, tapered roller bearings, pressurized bushings, gas bearings, and magnetic suspension bearings. Although an embodiment shows a stack of rotor disks operating in parallel, they may be arranged to operate in series. Although the embodiments show a spiral channel upon a conical and disk rotor respectively, the channel may be upon a rotor of any shape, including but not limited to cylindrical, spherical, hyperbolic, or organic. Although the embodiments show rotors of substantially unitary construction, the rotors may include at least one clutch, allowing a variable number of rotor disks or segments to engage at a time. Although the embodiments show rotors within a single housing, the rotors may be contained within two or more housings, and upon a common drive shaft, such that they may pump a two-part resin or other formulaic mixture of fluids. Although the embodiments show accommodations for pressure sensors and thermocouples, these accommodations may be extended to include any variety of sensor, including but not limited to RPM, flow rate, x-rays, ultraviolet, visible light, infrared, video inspection, viscosity, dielectric, conductivity, and others.

While the invention has been described with reference to details of the illustrated embodiments, these details are not intended to limit the scope of the invention as defined in the appended claims. The embodiment of the invention in which exclusive property or privilege is claimed is defined as follows.

We claim:

1. A boundary-layer pump comprising: a pump body configured to receive a rotor assembly, said rotor assembly comprised of an input shaft configured to rotate the rotor assembly and a laminar fluid flow channel, wherein said pump body has a proximal end proximal to the input shaft and a distal end distal to the input shaft, at least one primary inlet port and at least one primary outlet port and an adjustment cap, wherein the rotor assembly is comprised of at least one rotor disk positioned on a shaft-type rotor wherein each of the at least one rotor disks are alternately positioned from 0.000 to 0.010 inch spacing between a corresponding at least two stationary stator disks, wherein the at least two stator disks are separated by at least one disk spacer.

2. The boundary-layer pump of claim 1, wherein said at least two stator disks are coupled to the pump body.

3. The boundary-layer pump of claim 1, wherein said at least two stator disks are coupled to the adjustment cap.

4. The boundary-layer pump of claim 1, wherein said at least two stator disks are coupled to a body spacer.

5. The boundary-layer pump of claim 1, further comprising at least one disk seal configured to prevent unwanted fluid flow from the outlet to the inlet.

6. The boundary-layer pump of claim 1, further comprising at least one body seal configured to prevent unwanted fluid leakage to an exterior of the boundary-layer pump.

7. The boundary-layer pump of claim 1, wherein said laminar fluid flow channel is comprised of at least one secondary inlet port positioned on each of the rotor disks, said at least one secondary inlet port configured to allow fluid communication to the at least one rotor disk, at least one secondary outlet port positioned on each of the rotor disks configured to allow fluid communication and the at least one primary outlet port.

8. The boundary-layer pump of claim 1, further comprising at least one adjustment screw configured to change the distance between the pump body and the adjustment cap.

9. The boundary-layer pump of claim 1, further comprising a priming module said priming module comprising of an inlet, an outlet, a reservoir, and a priming valve.

10. The boundary-layer pump of claim 1, further comprising a suction valve.

11. The boundary-layer pump of claim 10, further comprising a priming pump, said priming pump in fluid communication with a suction plunger within the suction valve.

12. The boundary-layer pump of claim 1, further comprising at least one body spacer positioned adjacent to the pump body.

13. The boundary-layer pump of claim 1, further comprising a priming fan configured to produce a negative pressure with respect to a supply line.

14. The boundary-layer pump of claim 1, further comprising an eduction nozzle.

15. The boundary-layer pump of claim 1, wherein the at least one rotor disk has the laminar fluid channel which is perforated through the entire thickness of the at least one rotor disks.

16. The boundary-layer pump of claim 1, wherein at least one of the stator disks has the laminar fluid channel which is perforated through the entire thickness of the at least one rotor discs.

17. The boundary-layer pump of claim 1, wherein the laminar fluid channel has a spiral pitch.

18. The boundary-layer pump of claim 1, wherein the at least one rotor disk is comprised of transfer jogs to pass fluid flow radially or axially from one circular flow path to another concentric flow path upon the same rotor disk.

19. The boundary-layer pump of claim 1, wherein said at least two stator disks are comprised of at least one transfer jog to pass fluid flow radially or axially from a circular flow path to a concentric flow path upon a same stator disk.

* * * * *